United States Patent [19]

Spivey

[11] 3,963,915

[45] June 15, 1976

[54] WATERTIGHT LIGHT ASSEMBLY

[76] Inventor: Jack B. Spivey, 300 Casper St., Edmonds, Wash. 98020

[22] Filed: Feb. 15, 1974

[21] Appl. No.: 443,087

[52] U.S. Cl. ..... 240/7.1 R; 240/7.5

[51] Int. Cl.[2] ..... B63B 45/04

[58] Field of Search ..... 240/7.1 R, 7.5, 26, 240/152, 8.16, 8.3, 8.2, 8.26, 7.37, 57; 248/27, 226 R; 403/253

[56] References Cited

UNITED STATES PATENTS

| | | | |
|---|---|---|---|
| 1,706,459 | 3/1929 | Neuner | 240/57 |
| 1,745,901 | 2/1930 | McKay et al. | 240/26 |
| 2,171,089 | 8/1939 | Hawkins | 240/8.2 |
| 2,219,940 | 10/1940 | Ritz-Woller | 240/8.2 X |
| 2,736,528 | 2/1956 | Brock | 240/52.1 X |
| 2,908,807 | 10/1959 | Perkins | 240/7.5 |
| 3,046,388 | 7/1962 | Shinn | 240/26 X |
| 3,100,085 | 8/1963 | Dover | 240/8.3 |
| 3,275,816 | 9/1966 | Brunger | 240/8.22 |
| 3,515,862 | 6/1970 | Spivey | 240/7.5 |

*Primary Examiner*—Monroe H. Hayes
*Assistant Examiner*—Alan Mathews
*Attorney, Agent, or Firm*—Seed, Berry, Vernon & Baynham

[57] ABSTRACT

A watertight light assembly in which a housing with a lens face has a base closure through which a bulb socket member extends and provides a hollow mounting stud through which the power leads pass. The stud has an elastomeric sealing plug permitting the leads to move axially relative to the socket during introduction or removal of a bulb.

4 Claims, 2 Drawing Figures

WATERTIGHT LIGHT ASSEMBLY

BACKGROUND OF THE INVENTION

The present invention relates to watertight taillight assemblies for vehicles, and particularly for boat trailers.

It is common in the launching of a boat from a trailer, or in the reloading of the boat on the trailer, to back the trailer into the water to an extent submerging the taillights of the trailer. As a result, water enters and lodges in the light assemblies causing corrosion of the components, shorting of the circuits, and consequent premature light failure. The invention of my prior patent, U.S. Pat. No. 3,518,862, was directed to this problem. The present invention aims to provide a further improved watertight light assembly which is easier and more economical to assemble and is more foolproof as respects its watertight integrity.

In my prior light assembly the bulb was housed in a two-part lens and base unit and fitted in a socket which had an integral hollow stud extension projecting outwardly from the base. This stud served as the ground and as a conduit for the power leads to the light as well as the means for mounting the housing. A rigid plastic core in the stud was used to seal around the leads. This arrangement necessitated that the part of each lead between the sealing plug and the terminal end of the lead in the socket which engaged one of the bulb terminals be bent laterally to provide an excess portion so as to permit the terminal end to move during introduction or removal of the bulb and to be spring-urged against the base of the bulb by a spring surrounding the leads between the sealing plug and a thrust washer engaging the terminal at the end of the lead. The present invention eliminates the need to laterally bend the leads in the socket and gives superior operation by providing an elastomeric sealing plug which acts as a diaphragm and permits the leads to move axially in the stud extension of the socket while keeping the unit watertight. The invention also provides an improved mounting arrangement for the socket in the base of the light housing and for the housing on the vehicle.

DETAILED DESCRIPTION OF THE DRAWINGS

Figure 1:
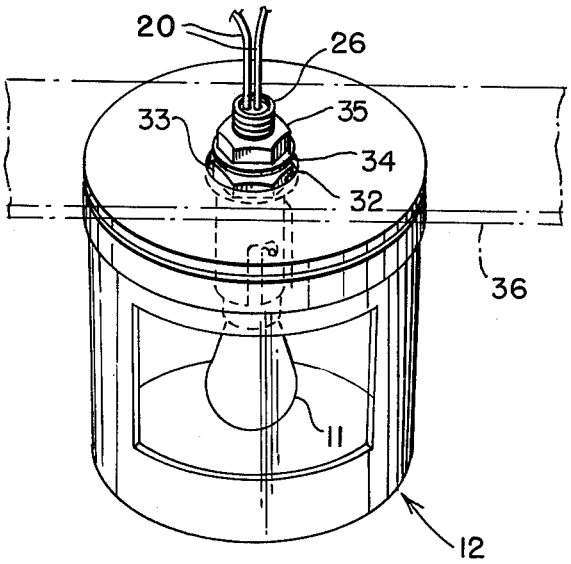
FIG. 1 is a perspective view showing a light assembly made in accordance with the present invention mounted in operating position.

Referring to the drawing, it is seen that the light assembly of the invention includes a socket 10 for an incandescent bulb 11 and a watertight housing comprising a translucent lens 12 and a base plate 13 which are screwed together. The socket 10 is of standard construction in that it has a pair of diametrically opposite bayonet slots 14 for receiving locking prongs 15 radiating from the base ferrule 16 of the bulb 11. These slots are conventionally axially spaced relative to one another so that the bulb will always have the same orientation relative to the socket and thereby maintain the taillight and stoplight terminals 17 at the base of the bulb opposed to the proper terminal buttons 18 for the power leads 20. These buttons seat on the outer face of a dielectric thrust washer 21 and have hollow stems extending through the washer and crimped to the leads.

The washer has a radially projecting orientation ear 22 slidably fitting in a guide rib 23 formed on the wall of the socket. A compression spring 24 urges the washer toward the bulb to keep the terminal buttons 18 in contact with the bulb terminals 17. At its inner end the spring 24 is seated in an annular shoulder 25 at the base of the socket 10 which integrally connects with an externally threaded hollow stud 26 through which the leads pass. The socket and stud unit is electrically conductive to serve as the ground for the light circuit and is preferably galvanized or otherwise suitably treated for corrosion resistance. To the extent thus far described the socket assembly is conventional.

The lens and base components of the housing are molded from a suitable plastic and are sealed by a rubber O-ring 27, seated between the outer lip of the lens 12 and a peripheral step on the base plate from which an externally threaded boss 28 extends to make a screw connection with inside threads formed in the mouth of the lens. The outer edge of the base plate extends radially beyond the lens and is serrated to provide a hand grip.

At its center the base plate has an inner stepped boss 30 providing a central annular seat 31 for the base of the socket 10 and a through-opening for the stud 26. This opening merges with an outside center recess 32 for receiving a backing nut 33 threaded on the stud. The stud 26 is also provided with a lock washer 34 and clamping nut 35 for securing the unit to a vehicle mounting bracket 36. It is preferred that the backing nut be slightly thicker than the depth of the recess 32 and thereby protrude beyond the outer face of the base plate 13 so as to directly take the pressure exerted by the inside face of the mounting bracket 36 when the clamping nut 35 is tightened on the stud 26 against the outer face of the bracket.

As part of the present invention the stud 26 is provided with a watertight elastomeric plug 37 which is bonded to the inner wall of the stud and to the insulating jackets of the power leads 20, and the leads also have a watertight construction so that water is prevented from passing through the stud or the leads into the light housing. The plug 37 is preferably formed from a suitable non-corrosive silicone rubber adhesive-sealant, such as "3144 RTV" of Dow Corning Corporation, Midland, Michigan, which can be applied from a squeeze tube or by automatic dispensing equipment. The jackets of the leads 20 are of a suitable thermoplastic to which the plug material will bond, and the wire strands of the leads may be of tinned copper and have a rope-lay. Significantly, each strand is coated during the laying of the wire with a suitable adhesive-sealant so that the strands of the leads are bonded to one another and to the jacket. This type of watertight wire construction has been heretofore known but not in the art to which this invention pertains.

The plug 37 is formed in the stud 26 after the socket components have been assembled with the leads threaded through the stud and a bulb in place with its prongs 15 in the bayonet slots 14 and the spring 24 compressed between the dielectric plate 21 and the base shoulder 25 of the socket. To then form the plug, the plug material is introduced in a suitable viscous state through the mouth of the stud 26 and around the leads 20. The plug material is then cured and as it solidifies it bonds directly to the inside wall of the stud and to the outer face of the insulating jackets of the leads.

Figure 2:
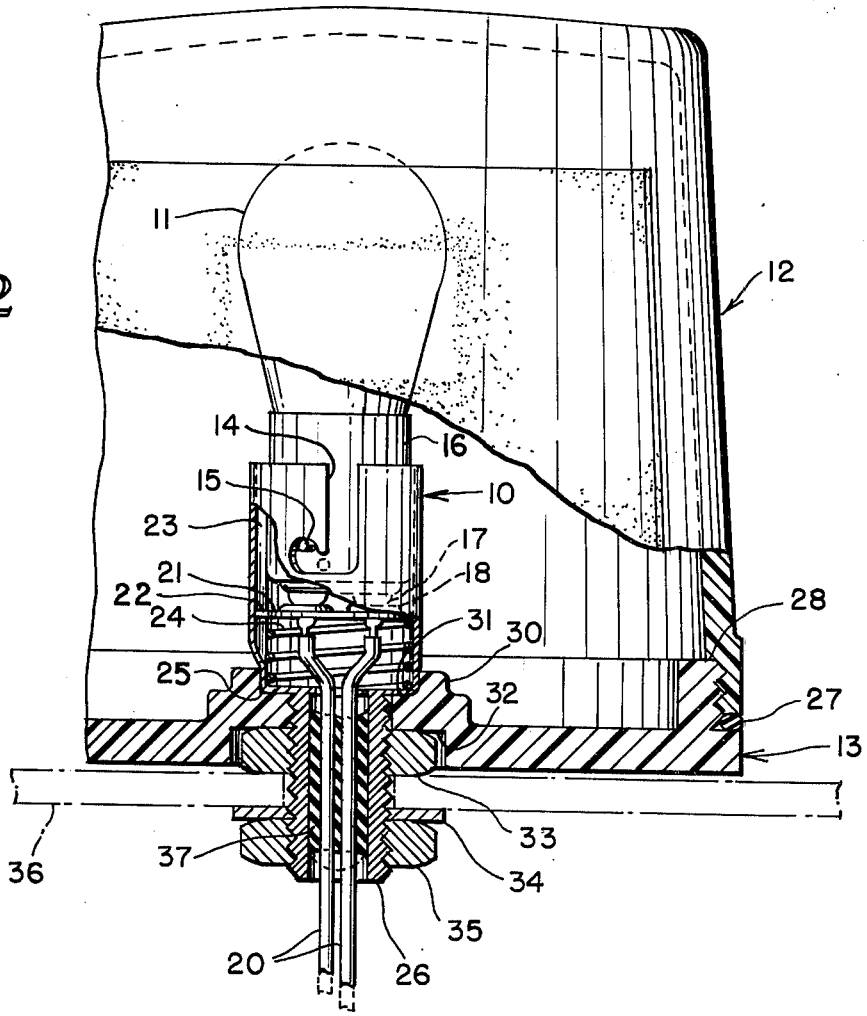
FIG. 2 is a center fragmentary vertical sectional view of the light assembly to an enlarged scale.

It is significant that the plug material is introduced and cured while the bulb 11 is in actual operating position indicated by the full line position in FIG. 2. Then, when the bulb is pressed inwardly in opposition to the spring and turned so that its prongs are moved toward the mouth of the bayonet slots as shown by the broken line position in FIG. 2, to thereby free the bulb for replacement, the portion of the leads between the base of the bulb and the sealing plug 37 is free to move with the bulb axially of the socket by way of elastic deformation of the plug as indicated in FIG. 2 by the broken line position of the outer end of the plug. In other words, the sealing plug has a spring diaphragm action when the spring 24 is compressed during removal and insertion of a bulb. It will also be noted that when there is not any bulb in the socket, the spring is kept partially compressed by the leads 20 which then have moved endwise under action of the spring 24 toward the mouth of the socket an amount determined by elastic deformation of the plug 37 in a manner opposite to that indicated by the broken line in FIG. 2.

The socket 10 is bonded to the base plate 13 to provide a watertight connection therebetween. This is accomplished by coating the seat 31 with an epoxy resin or other suitable adhesive; and then after placing the socket 10 in position, threading the backing nut 33 onto the stud 26 and tightening it in the recess 32 to firmly press the shoulder portion 25 of the socket against the adhesive-coated seat 31. This operation can be accomplished before or after assembly of other socket components and forming of the sealing plug 37 in the manner previously described.

From the foregoing description it can be seen that the housing for the light is kept watertight. The mounting arrangement, by not subjecting the base plate 13 to direct pressure against the mounting bracket on the vehicle when the nut 35 is tightened, keeps the housing backing plate from being subjected to warping forces from the mounting bracket which might endanger the watertight integrity.

The embodiments of the invention in which an exclusive property or privilege is claimed are defined as follows:

1. A light socket assembly, comprising:

a socket member having an annular spring seat opposite the mouth of the socket and having a hollow stud extending from the set, said socket having bayonet slots for receiving prongs on a light bulb, watertight conductor lead means passing axially through the stud to a terminal end in the socket, an elastomeric watertight diaphragm plug in the stud bonded to the stud and to the lead means, said bonding between the plug and stud preventing the plug from sliding along the stud and said bonding between the plug and lead means transmitting axial forces from the lead means to the plug to axially deform the plug when an axial force is exerted on the lead means, a thrust member in the socket fastened to the terminal end of the lead means and adapted to contact a conducting portion of a light bulb in the socket, and compression spring means extending between the seat and thrust member urging the thrust member away from the stud, thereby placing an axial force on the lead means and axially deforming the diaphragm plug when a light bulb is not in the socket.

2. In combination:

a watertight light housing assembly having a watertight closure for access to a light bulb in the housing, a light socket mounted in the housing assembly, a bulb in the socket and having a terminal, a through-passage in the housing assembly, a power lead extending through said passage to a terminal contact in the socket, said lead having a jacket and having multiple conductor strands in the jacket bonded to one another and to the jacket whereby the lead is watertight, an elastomeric watertight diaphragm bonded to the jacket and to the wall of the passage, and spring means in the socket urging the terminal contact against the bulb terminal and away from the passage, thereby tensioning the lead inside the housing against the force imparted to the lead by the diaphragm when the diaphragm is deformed responsive to axial movement of the lead caused by said tensioning.

3. The combination of claim 2 in which said socket has a bayonet slot and said bulb has a prong seated in said slot for holding said bulb in said socket in opposition to said spring means, the length of said lead between the diaphragm and terminal contact being such that the diaphragm is in a relaxed condition when said prong is seated.

4. In combination: a watertight light housing assembly having a base plate and a watertight closure for access to a light bulb in the housing, a light socket having a bayonet slot and a terminal contact located therein, said socket being mounted in the housing and seated against the inside of the base plate, a hollow, externally threaded mounting stud extending through the base plate from the socket, an annular recess in the outside of the base plate and surrounding the stud, a backing nut on the stud and seated in the recess to clamp the socket against the base plate, said nut extending outwardly slightly beyond the outside of the base plate for bearing directly against a vehicle mounting bracket with the stud projecting through the bracket and receiving a clamping nut, a power lead extending through the mounting stud to the terminal contact in the socket, said lead having a jacket and having multiple conductor strands in the jacket bonded to one another and to the jacket whereby the lead is watertight, a bulb in the socket having a terminal corresponding to the terminal contact in the socket and a prong seated in the slot of said socket, an elastomeric, watertight diaphragm bonded to the jacket and to the internal wall of the mounting stud, and spring means urging the terminal contact against the bulb terminal and away from the passage, thereby tensioning the lead inside the housing against the force imparted to the lead by the diaphragm when the diaphragm is deformed responsive to axial movement of the lead caused by said tensioning.

* * * * *